United States Patent [19]

Joshi

[11] 4,169,067

[45] Sep. 25, 1979

[54] BAR PRODUCT

[75] Inventor: David P. Joshi, Plainfield, N.J.

[73] Assignee: Colgate-Palmolive Company, New York, N.Y.

[21] Appl. No.: 816,123

[22] Filed: Jul. 15, 1977

[51] Int. Cl.[2] ..... C11D 9/22; C11D 15/04

[52] U.S. Cl. ..... 252/132; 252/134; 252/174; 252/DIG. 16; 252/174.21; 252/359; 252/367; 252/368

[58] Field of Search ..... 252/134, 132, 174, DIG. 16, 252/177, 359, 367, 368

[56] References Cited

U.S. PATENT DOCUMENTS

| | | | |
|---|---|---|---|
| 3,179,596 | 4/1965 | Farrar et al. | 252/132 X |
| 3,576,749 | 4/1971 | Megson et al. | 252/132 |
| 3,598,746 | 8/1971 | Kaniecki et al. | 252/132 |
| 3,694,367 | 9/1972 | Peters et al. | 252/368 X |
| 3,835,058 | 9/1974 | White | 252/174 X |
| 3,944,663 | 3/1976 | Weiss et al. | 252/132 X |

FOREIGN PATENT DOCUMENTS 42734 1/1966 German Democratic Rep. .

OTHER PUBLICATIONS

Ency. of Chemical Tech. (2nd ed.), vol. 18, pp. 415–432.
Polyox Water-Soluble Resins Union Carbide.
Davidson et al., "Water Soluble Resins", Rheinhold Pub. Corp., N.Y., N.Y., 1962, pp. 197–198.

*Primary Examiner*—Mayer Weinblatt
*Attorney, Agent, or Firm*—Herbert S. Sylvester; Murray M. Grill; Norman Blumenkopf

[57] ABSTRACT

Toilet soap bars superfatted with higher fatty acids and containing high molecular weight poly(ethylene oxide).

8 Claims, No Drawings

BAR PRODUCT

Superfatted toilet soap bars (such as those sold as cosmetic or complexion bars) are well known in the art and are described, for instance, in the U.S. patent to Megson et al U.S. Pat. No. 3,576,749. As pointed out in the Megson patent, such bars are unlike bars made of synthetic detergents which, according to that patent, give a very soft, slimy, messy type of smear . . . which is unacceptable in soap bars. According to the Megson patent free fatty acids in the bar improve the volume and quality of the lather, causing it to be more stable with small air bubbles which gives the user a lather which is characterized as "richer" and creamier, and the fatty acids also tend to soften the skin. The Megson patent teaches that with such superfatted bars relatively large amounts of sodium chloride and relatively high milling temperatures are required in order to attain firmness of the bar and smear resistance.

In accordance with one aspect of this invention there are provided superfatted toilet soap bars which form a rich creamy lather and which give an extremely pleasant feel both in use and after use; when compared to commercial superfatted toilet soap bars which are believed to be made according to the teachings of Megson it is found that the novel bars of this invention are greatly preferred by users, with respect to the nature of the lather and other characteristics. The bars are firm and have high resistance to sloughing or smear without the need for incorporation of added sodium chloride and without the need for using high milling temperatures.

In one aspect of this invention, the superfatted soap bars contain an amount of free higher fatty acid in the range of about 6 to 12%, such as about 8 to 10%, together with a high molecular weight poly(ethylene oxide) in amount in the range of about 1 to 4% preferably about 1½ to 2½% or 3%. I have also found that poly(ethylene oxide)-containing superfatted bars which have particularly good slough- or smear-resistant properties comprise a sodium soap of about equal proportions of coco fatty acids and tallow fatty acids superfatted with about equal amounts of coco fatty acids and stearic acid, as can be seen, for instance, in the data tabulated in Example 1 below.

Soap is conventionally manufactured by the saponification of fatty acids or esters (e.g. fats and oils) by either a "kettle" process or a continuous saponification technique, as discussed in *Encyclopedia of Chemical Technology* (2nd edition) Vol. 18 pages 415–425, which states that "the end product of both the kettle and continuous saponfication procedures is a neat soap containing approximately 30% water . . . The 30% water content of neat soap must be reduced to 10–15% before shaping into bars . . ." In one aspect of the invention the superfatted soap is a product resulting from the incorporation of high molecular weight poly(ethylene oxide) into the neat soap prior to the drying of the latter and preferably from the mixing of the neat soap with a dispersion of the poly(ethylene oxide) in higher fatty acid. A particularly suitable process for effecting such mixing is described in my copending application Ser. No. 819,119 filed on the same date as the present application and entitled "Process", whose entire disclosure is incorporated herein by reference; in that process, some moisture is preferably included with the fatty acid-polymer mix, forming a water-in-oil type of dispersion and significantly reducing the viscosity.

The use of this invention makes it possible to produce toilet soap bars which give a rich and creamy, but only moderately slippery, lather and which are firm and resistant to sloughing and cracking in use.

The following Examples are given to illustrate this invention further. In this application all proportions are by weight unless otherwise specified.

EXAMPLE 1

4.5 parts of stearic and 4.5 parts coco fatty acids are melted together at a temperature of 80° C. in a vessel equipped with a stirrer. 1.8 parts of high molecular weight poly(ethylene oxide) ("Polyox WRS N-750" sold by Union Carbide, having a molecular weight of about 300,000, a viscosity [when measured on a 5% solution in water] of about 550 to 900 cps at 25° C., and a melting point in the neighborhood of 65° C.) are added thereto with stirring while maintaining the blend at about 80° C. This blend is then mixed with a kettle soap (at 70° C.) in such proportions that the resulting mixture contains about 75 parts of the sodium soap (expressed as anhydrous soap), 4.5 parts of the added stearic acid, 4.5 parts of the added coco fatty acids and 1.8 parts of the poly(ethylene oxide). The kettle soap is made by saponifying a 50/50 mixture of coconut oil and tallow with sodium hydroxide solution, extraction of resultant glycerine, "washing" with electrolyte solution and removal of high electrolyte nigre soap layer all as is conventional in the manufacture of kettle soaps; it contains about 27–32% (e.g. 30%) water, up to about 1% (e.g. 0.5%) glycerol, up to about 0.3% (e.g. 0.1%) NaOH, up to about 1% (e.g. 0.7%) NaCl. The ingredients are stirred together for a few minutes and the mixture is then formed into dried soap chips containing about 10% moisture, as by pumping the hot soap mixture onto a chilled roll, forming a thin film on the roll, slicing the film into chips or ribbons and then drying the chips or ribbons. The chips are then blended with color and perfume (e.g. 0.7% $TiO_2$ and 1.5% perfume) in conventional manner in a soap amalgamator at about room temperature, then milled to homogenize them (e.g. at a temperature of about 15° to 35° C.), then extruded into a bar form by means of a conventional soap plodder (e.g. at a temperature of about 20°–50° C., e.g. 40° C.), then cut into cakes; the surfaces of the cakes are cooled and the cakes are pressed into the desired shapes (e.g. in a pin-die press).

(b) Example 1a is repeated except that instead of using 4.5 parts stearic acid and 4.5 parts coco fatty acids there is employed 9 parts stearic acid.

(c) Example 1a is repeated except that instead of using 4.5 parts stearic acid and 4.5 parts coco fatty acids there is employed 9 parts coco fatty acids.

On testing the soap bars (after aging at least 3 days) the following results are obtained:

| | Sponge Lather No. of Strokes | Slough (17 hr.) % loss | Erosion 95° F. | Erosion 100° F. | Hydration (2 hr.) % gain | Cracking Index |
|---|---|---|---|---|---|---|
| (a) | 60 | 1.5 | 2.6 | 16.1 | 12.5 | 18 |
| (b) | 80 | 3.5 | 2.2 | 18.8 | 11.6 | 15 |
| (c) | 68 | 5.2 | 18.7 | 19.6 | 10.8 | 0 |

In the sponge lather test, which measures the quickness of lather formation, the bar's flat surface is alternately rubbed against a sponge and dipped in a pan of water (with a hardness level of 125 ppm and a temperature of 95° F.). The up-and-down motion of the lather machine produces the number of strokes it requires to form a continuous ring of foam in the pan. The less the number of strokes, the quicker the lather In the slough test, the bars are placed flat with one side immersed in a Petri dish for seventeen hours, after which time the soft, mushy soap is removed by fingers. The percent weight lost as slough is reported. In the erosion test the bar is immersed in water for 260 strokes (about 10 minutes) of the lather machine, and the amount of soap lost is measured. In the hydration test the bars are completely immersed in tap water for two hours and the increase in weight is determined. The cracking index is an evaluation based on number and severity of cracks in a test in which the bars are shaved on one side to half their original sizes then placed under tap water (about 100 ppm hardness) for one hour, taken out and hung to dry in air until no sign of free water remains on their surfaces (usually overnight).

The bar of Example 1a shows unexpectedly high lather quickness, unexpectedly low slough loss and erosion loss and quite acceptable cracking behavior.

EXAMPLE 2

Bars are made as in Example 1a except that they also contain 0.5% lanolin with and without 0.5% sodium caseinate solids, these ingredients being incorporated with the hot fatty acid-poly(ethylene oxide) blend before mixing it with the kettle soap.

It is preferred that the amount of moisture in the ingredients added to the kettle soap be such that the moisture:soap ratio be maintained below about 33:67 (such as about 27:73 to 32:68) to minimize formation of less desirable gel soap phase.

It is desirable, particularly in the formulations containing relatively large amounts of coco fatty acids (such as 1A) to dry to a moisture content below about 12% in order to reduce the tendency for stickiness during later blending (e.g. in the amalgamator) or processing. To the same end it is desirable to use relatively low plodding temperatures, pre-cool and -dry the outer surfaces of the bars before pressing in the dies, and lubricate the dies (e.g. with an aqueous solution containing 16% NaCl and 25% glycerol, which is then air-blown off the surfaces of the pressed bars).

In one modification, only a part (e.g. about one half) of the poly(ethylene oxide) is added (with the fatty acids) to the kettle soap, the remainder being added in powder form to the soap chips in the amalgamator prior to the addition of the pigment.

The high molecular weight poly(ethylene oxide) has an average molecular weight of at least about 100,000. Examples of such compounds are those sold by Union Carbide Company under the trademark "Polyox". These polymers are nonionic materials, soluble in water and their molecular weights range from about 100,000 to about 5,000,000 or more. It is preferred to employ polymers having average molecular weights below 1,000,000, more preferably not above about 600,000 such as about 300,000 to 400,000. For the material having an average molecular weight of about 300,000 a proportion in the neighborhood of 2% has given excellent results. This 300,000 molecular weight material (sold as Polyox WSR N-750) has a viscosity at 25° C., for a 2% aqueous solution, of about 40 centipoises (Brookfield Spindle No. 1 at 10 rpm): for a 5% solution this viscosity is about 600–1000 centipoise. Use of say 2% of extremely high molecular weight polyethylene oxide), e.g. of 4,000,000 average molecular weight, causes the lather to be pituitous, which is less desirable. According to the manufacturer the Polyox materials typically have a pH of about 10 (e.g. in 5% solution). Soap typically has a pH in 1% aqueous solution of about 10 (e.g. 10.2), while the superfatted soaps of this invention generally have lower pHs such as about 9.5.

The poly(ethylene oxide) is generally supplied as a powder and typically has the following particle size distribution when a sample thereof is screened through a series of sieves, expressed as weight percent retained on the indicated Sieve No. screen (U.S. Sieve Series): No. 20–5.2%; No. 40–31.2%; No. 60–20.7%; No. 100–16.7% and through No. 100-balance. It is often preferable to use a finer particle size poly(ethylene oxide) having the following distribution as measured above: No. 20–0.3%; No. 40–13%; No. 60–13%; No. 100–13.9% and through No. 100-balance.

Best results have thus far been obtained by using a soap made by saponifying a blend of about equal parts of tallow and coconut oil. Generally it is preferred to use a tallow-coco ratio within the range of about 2:1 to 1:2 such as 3:2 or 2:3.

Before mixing it with the various ingredients, the kettle soap is preferably stabilized, as by incorporating into it about 0.06% $SnCl_4$ and 0.024% tetrasodium salt of ethylenediaminetetraacetic acid, these being added as aqueous solutions.

With respect to the superfatting acid, best results have thus far been obtained when this comprises about equal proportions of stearic and coco fatty acids. Generally it is preferred to use these acids in a ratio within the range of about 2:1 to 1:2 such as 3:2 or 2:3. The total amount of superfatting acids in the bar is generally less than about 15%.

It will be understood that cation-exchange of Na and H may occur during processing of the soap-fatty acid mixture and that it is most convenient to express the distribution of chain lengths in the mixture in terms which lump together the saponified and unsaponified fatty acids. Typical distributions, so expressed, in bars of this invention are tabulated below:

| Number of carbon atoms in fatty acid (fatty acid is saturated unless otherwise noted) | Percent | |
|---|---|---|
| | a | b |
| 8 | 3.1 | 2.8 |
| 10 | 2.9 | 2.6 |
| 12 | 24.3 | 21.5 |
| 14 | 11.0 | 10.5 |
| 14 monounsaturated | 0.2 | 0.5 |
| 15 | 0.2 | 0.3 |
| 15 monounsaturated | — | — |
| 16 | 19.0 | 18.6 |
| 16 monounsaturated | 1.0 | 1.7 |
| 17 | 0.6 | 0.4 |
| 17 monounsaturated | 0.3 | — |
| 18 | 13.4 | 12.6 |
| 18 monounsaturated | 21.6 | 25.9 |
| 18 diunsaturated | 2.1 | 2.1 |
| 18 triunsaturated | 0.3 | 0.3 |
| Summary | | |
| up to $C_{12}$ | 30.3 | 26.9 |
| $C_{16}$-$C_{14}$ | 31.4 | 31.6 |

-continued

| Number of carbon atoms in fatty acid (fatty acid is saturated unless otherwise noted) | Percent | |
|---|---|---|
| | a | b |
| $C_{18}$-$C_{17}$ | 38.3 | 41.3 |

With respect to the moisture content below about 12% during processing, it should be noted that in use, or storage, after processing the moisture content may increase (see, for instance, the hydration data in Example 1); preliminary results indicate, however, that the bars have a significantly lower tendency to hydrate than commercial superfatted bars.

Conventional kettle soap contains up to about 1% (e.g. 0.7%) sodium chloride. The products of this invention have good smear resistance without the need for addition of sodium chloride, although it will be understood that such additions (as in the Megson et al patent) are not excluded from the broader scope of the invention. The bars of this invention have good hardness, comparable to or greater than that of ordinary toilet soap at 90° F., when the milling is carried out at conventional relatively low temperatures (that is, their Dietert hardness at 90° F. is above about 85, e.g. 90 to 92); there is no need to use the higher milling temperatures set forth in the Megson et al patent although it will be understood that the use of such milling temperatures is not excluded from the broader scope of the invention.

The fatty acids in the soap and superfat, and the relative proportions of the various acids, may be as described in the Megson U.S. Pat. No. 3,576,749. The superfatting acid may contain fatty acids having an odd number of carbons; thus one may employ a fatty acid mixture containing equal proportions (one third each) of $C_{11}$, $C_{12}$ and $C_{13}$ saturated fatty acids (Monsanto CR-1157).

The soap bars of this invention may contain conventional ingredients such as opacifiers (e.g. 0.4% titanium dioxide added in the amalgamator), lanolin (e.g. ½% added to the neat soap, preferably in admixture with the superfat),glycerine (e.g., 1% added in the amalgamator or to the neat soap), soap perfume (e.g. 1–3% such as 1.5–2% added in the amalgamator), antioxidants (e.g. 0.02% di-t-butyl p-cresol or BHT added to the neat soap), protein (e.g. 0.5% sodium caseinate, added to the neat soap or, as an aqueous solution, in the amalgamator). Antibacterials or germicides such as those mentioned in Megson U.S. Pat. Nos. 3,576,749 and Kaniecki 3,598,746 may be included. It is within the broader scope of the invention to aerate the bars, in a manner well known in the art, to give lower density (floating) soaps, such as those having a specific gravity of about 0.8.

Toilet soap bars range in size from the relatively small hotel size (weighing about 20–30 grams) to the regular size (about 100 grams) to the bath size (about 150g) to the extra large size (about 200 g). The bars of this invention may be of such 150 particularly in the range of about 100 to 200 grams.

As mentioned above, the poly(ethylene oxide) may be incorporated in two stages, one portion (such as about half or two thirds of the total polymer) being incorporated into the neat soap and the other portion being added to the soap chips in the amalgamator. In order to reduce the tendency to form specks when the latter addition is made in the amalgamator it is desirable to add the polymer there in the form of very finely ground material (such as material of which 98% passes through a No. 100 screen (U.S. Sieve series) and to thoroughly distribute the powdered polymer on the surfaces of the chips in the amalgamator prior to adding the other ingredients such as pigment. When a significant portion of the total polymer is incorporated into the neat soap, the soap is less sticky during the incorporation of the balance of the polymer in the amalgamator and the amalgamation process may be accomplished more easily and with less power.

It is understood that the foregoing detailed description is given merely by way of illustration and variations may be made therein without departing from the spirit of the invention.

I claim:

1. A toilet soap bar consisting essentially of sodium soap of higher fatty acids having about 10 to 20 carbon atoms as substantially the sole detergent, about 6 to 12 wt.% of superfatting higher fatty acids having about 10 to 20 carbon atoms, about 1 to 4 wt.% of poly(ethylenoxide) having a molecular weight in the range of about 100,000 to 5,000,000 and about 5 to 18 wt.% of water.

2. A toilet soap bar as in claim 1, in which said sodium soap is a mixture of tallow and coconut oil soaps in a weight ratio of about 1:2 to 2:1 and said superfatting acids comprise a mixture of stearic and coco fatty acids in a weight ratio of about 2:1 to 1:2.

3. A toilet soap bar as in claim 1 in which said molecular weight is about 300,000 to 600,000 and the proportion of poly(ethylene oxide) is about 1½ to 3 wt.%.

4. A toilet soap bar as in claim 3 in which said sodium soap is a mixture of tallow and coconut oil soaps in a weight ratio of about 1:2 to 2:1.

5. A toilet soap bar as in claim 3 in which said sodium soap is a mixture of about equal parts of tallow and coconut oil soaps and constitutes about ¾ of said bar, by weight.

6. A toilet soap bar as in claim 3 which said superfatting acids comprise a mixture of stearic and coco fatty acids in a weight ratio of ratio 2:1 to 1:2.

7. A toilet soap bar as in claim 3 in which said superfatting acids comprise a mixture of about equal parts of stearic and coco fatty acids.

8. A toilet soap bar as in claim 3 in which said sodium soap is a mixture of tallow and coconut oil soaps in a weight ration of about 1:2 to 2:1 and said superfatting acids comprise a mixture of stearic and coco fatty acids in a weight ratio of about 2:1 to 1:2.

* * * * *